US006352172B1

(12) United States Patent
Chan et al.

(10) Patent No.: US 6,352,172 B1
(45) Date of Patent: Mar. 5, 2002

(54) FOLDED WEB PRODUCT DISPENSING SYSTEM

(76) Inventors: Michael Yuwah Chan, 10435 Stanyan St., Alpharetta, GA (US) 30202; Paul Francis Tramontina, 155 Cobblestone Way, Alpharetta, GA (US) 30201

( * ) Notice: Subject to any disclaimer, the term of this patent is extended or adjusted under 35 U.S.C. 154(b) by 0 days.

(21) Appl. No.: 08/998,175

(22) Filed: Dec. 24, 1997

Related U.S. Application Data

(63) Continuation-in-part of application No. 08/816,288, filed on Mar. 13, 1997, which is a continuation-in-part of application No. 08/755,435, filed on Nov. 22, 1996.

(51) Int. Cl.[7] ..... E02F 3/76

(52) U.S. Cl. ..... 221/63; 221/49; 221/35; 221/310

(58) Field of Search ..... 221/49, 35, 45, 221/33, 48, 50, 60, 65, 63, 210, 213, 310

(56) References Cited

U.S. PATENT DOCUMENTS

| | | | | |
|---|---|---|---|---|
| 1,632,446 A | | 6/1927 | Krueger | |
| 1,683,641 A | | 9/1928 | Whitney | |
| 1,697,654 A | * | 1/1929 | Jantzen | 221/63 |
| 1,914,666 A | | 6/1933 | Hope et al. | |
| 2,143,614 A | | 1/1939 | Winter et al. | |
| 2,253,742 A | | 8/1941 | West et al. | |
| 3,203,586 A | | 8/1965 | Downham | 221/55 |
| 3,425,595 A | | 2/1969 | Shapira | |
| 5,090,592 A | | 2/1992 | Petterson et al. | 221/55 |
| 5,100,020 A | * | 3/1992 | Petterson et al. | 221/45 X |
| 5,199,601 A | * | 4/1993 | Roethel | 221/310 |

FOREIGN PATENT DOCUMENTS

| | | |
|---|---|---|
| FR | 336 986 A | 3/1904 |
| FR | 2 115 834 A | 7/1972 |

OTHER PUBLICATIONS

Counterpart PCT International Search Report, mailed Apr. 19, 1999.

* cited by examiner

*Primary Examiner*—Donald P. Walsh
*Assistant Examiner*—Gene O. Crawford
(74) *Attorney, Agent, or Firm*—Sue Corbett Watson

(57) ABSTRACT

A folded web product dispensing system includes an outer housing that defines an interior space. A dispensing face is defined in the outer housing proximate to an end of a stacking means. The dispensing face has a central portion and a dispensing throat located in the central portion. The stacking means are mounted within the outer housing for holding a stack of folded web product within the interior space and have a staging area proximate to the dispensing throat including at least two curved bumpers. These curved bumpers are oriented so as to be parallel to the path of travel of the folded webs as they approach the dispensing throat. A number of ribs may be defined on the bumpers for temporarily arresting movement of the folded webs as they approach the dispensing throat. The folded web product may be a stack of paper napkins.

8 Claims, 7 Drawing Sheets

FOLDED WEB PRODUCT DISPENSING SYSTEM

CROSS REFERENCE TO RELATED APPLICATIONS:

This is a continuation-in-part of U.S. patent application Ser. No. 08/755,435, filed on Nov. 22, 1996, and a continuation-in-part of U.S. patent application Ser. No. 08/816,288, filed on Mar. 13, 1997.

FIELD OF THE INVENTION

This invention generally relates the field of dispensing devices and systems. More particularly, this invention relates to the field of devices and systems for dispensing folded sheets of material.

BACKGROUND

Dispensers for folded web products such as, for example, paper napkins are often provided at quick service food locations. One disadvantage of many conventional paper napkin dispensers is that they often permit removal of large clumps of napkins at one time. Studies have shown most paper napkins removed in this manner are wasted. Many end up scattered about an eating area, tossed as litter or, even worse, being stuffed in plumbing fixtures. When clumps of napkins are taken, dispensers quickly run out and must be refilled inconveniencing both customers and operators of quick service food locations.

A long and unfilled need exists for a paper napkin dispensing system that will deter and resist wasteful dispensing.

SUMMARY OF THE INVENTION

The problems and needs described above are addressed by the present invention which provides a folded paper napkin dispensing system composed of: (a) an outer housing defining an interior space; (b) a dispensing face defined in the outer housing proximate to an end of a stacking means, the dispensing face has a central portion and a dispensing throat located in the central portion; and (c) stacking means mounted within the outer housing for holding a stack of folded web product within the interior space, the stacking means having a staging area proximate the dispensing throat including at least two curved bumpers oriented so as to be parallel to the path of travel of the folded webs as they approach the dispensing throat, and a number of ribs defined on the bumpers for temporarily arresting movement of the folded webs as they approach the dispensing throat.

The dispensing face has a central and a dispensing throat located in the central portion. In some embodiments of the invention, the central portion may project out from the dispenser The dispensing throat may be composed of a slot portion having a length sufficient to permit a paper napkin to be pulled through by a user, but a relatively narrow width that prevents more than a few napkins from being pulled through the throat at one time. The dispensing throat may further includes a finger access portion to help a user grip and pull a paper napkin through the dispensing slot despite the relatively narrow width of the dispensing slot.

According to the invention, the stacking means are composed of a staging area proximate the dispensing throat for spacing, bowing and slowing napkins as they approach the dispensing throat. The staging area may be composed of at least two curved bumpers oriented so as to be parallel to the path of travel of the napkins as they approach the dispensing throat, and a number of ribs defined on the bumpers for temporarily arresting movement of the napkins as they approach the dispensing throat. Desirably, the staging area and bumpers are configured to cause the napkins to bow out into the dispensing throat.

The curved bumpers may desirably have an exterior curve defined by a radius of from about 1.125 to about 1.750 inch and a chordal length of from about 1.625 to about 1.875 inch.

The ribs defined on the curved bumpers may each have a radius of from about 0.125 to about 0.250 inch. Other dimensions and shapes are contemplated.

In an aspect of the invention, the slot portion of the dispensing throat may have a point of minimum width that is less than about 1.0 inch. For example, the slot portion of the dispensing throat may have a point of minimum width that is less than about 0.75 inches. As another example, the slot portion of the dispensing throat may have a point of minimum width that is less than about 0.5 inches.

According to the invention, the finger access portion of the dispensing throat may have a point of maximum width that is greater than about 0.75 inches. For example, the finger access portion of the dispensing throat may have a point of maximum width that is greater than about 1 inch. Desirably, the finger access portion of the dispensing throat is at the center of the dispensing throat and may have a length (i.e., a length along the dispensing throat) of about 1 inch or more. For example, the finger access portion of the dispensing throat may have a length from about 1 inch to about 3 inches or more. Typically, the finger access portion of the dispensing throat may have a length that is about one-half the length of the dispensing throat. Of coarse, it is contemplated that the finger access portion of the dispensing throat may have a length that is about one-quarter to about three-quarter the length of the dispensing throat.

According to the present invention, the central portion of the dispensing face may project out from the dispenser in the form of a first surface and a second surface joined at an obtuse angle. In such an embodiment, the dispensing throat should be located at about the intersection of the first and second surfaces. Other configurations of the dispensing face which provide a crease or break in the plane of the dispensing face at the dispensing throat may also be used.

According to the invention, the stack of individual folded webs may be a stack of fibrous webs. Desirably, the stack of folded webs is a stack of absorbent paper webs such as, for example, absorbent paper napkins.

The folded webs may be interfolded webs, interleaved webs or may be individual folded webs. As an example, the stack of individual folded webs may contain individual webs composed of: (a) a first, central panel; (b) a second panel, unitary with said first panel and folded over a first side of said first panel; (c) a third panel, unitary with the first panel, and folded over a second side of the first panel; (d) a fourth panel, unitary with the second panel, and folded so as to be positioned between the first and second panels; and (e) a fifth panel, unitary with the third panel, and folded so as to be positioned between the first and third panels, such that a portion of the third panel and fifth panel overlap a portion of the second panel and fourth panel generating an area of non-uniform thickness across the length of the web.

In an embodiment of the invention, the stack of individual folded webs may have an area of non-uniform thickness across the length of the web is aligned so that an area of greatest thickness extends across the width of the dispensing throat.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying description of the invention.

DETAILED DESCRIPTION

Figure 1:
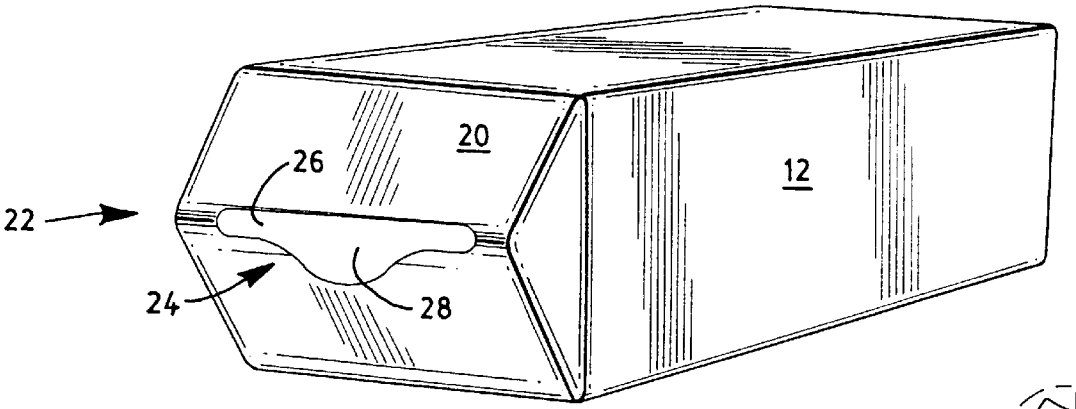
FIG. 1 is a perspective view illustration of an exemplary folded web product dispensing system.
Figure 2:
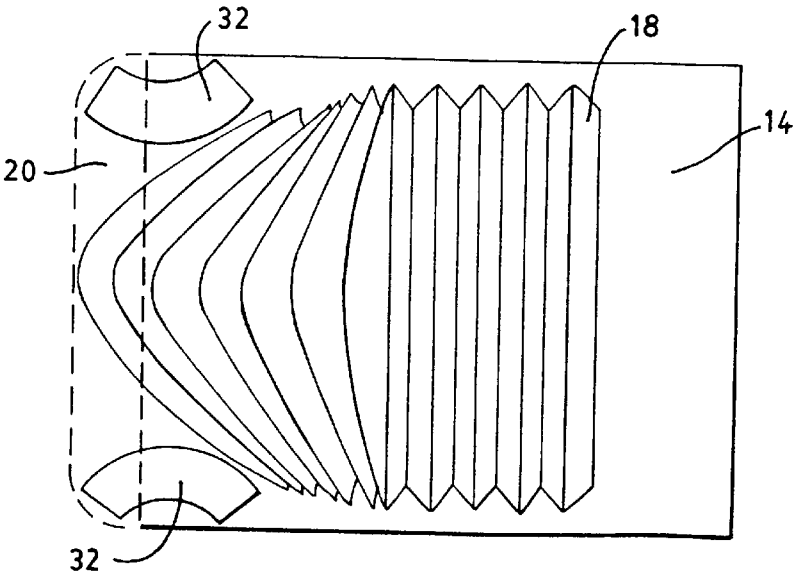
FIG. 2 is an illustration of a detail of an exemplary folded web product dispensing system.

Referring now to the drawings, wherein like reference numerals designate corresponding structure throughout the views, and referring in particular to FIGS. 1 and 2, there is shown an exemplary folded paper napkin dispensing system. The system includes an outer housing 12 defining an interior space 14 that contains a stacking means 16 which is mounted within the outer housing 12 for holding a stack of paper napkins 18 within the interior space.

The system also includes a dispensing face 20 defined in the outer housing 12 proximate to an end of the stacking means 16.

The dispensing face 20 has a central portion 22 that may project out from the outer housing 12 and a dispensing throat 24 located in the central portion 22. The dispensing throat 24 is composed of a slot portion 26 having a length sufficient to permit a paper napkin to he pulled through by a user, but a relatively narrow width that prevents more than a few napkins from being pulled through the throat at one time.

The dispensing throat 24 further includes a finger access portion 28 to help a user grip and pull a folded paper napkin through the dispensing slot despite the relatively narrow width of the dispensing slot 26.

Figure 3:
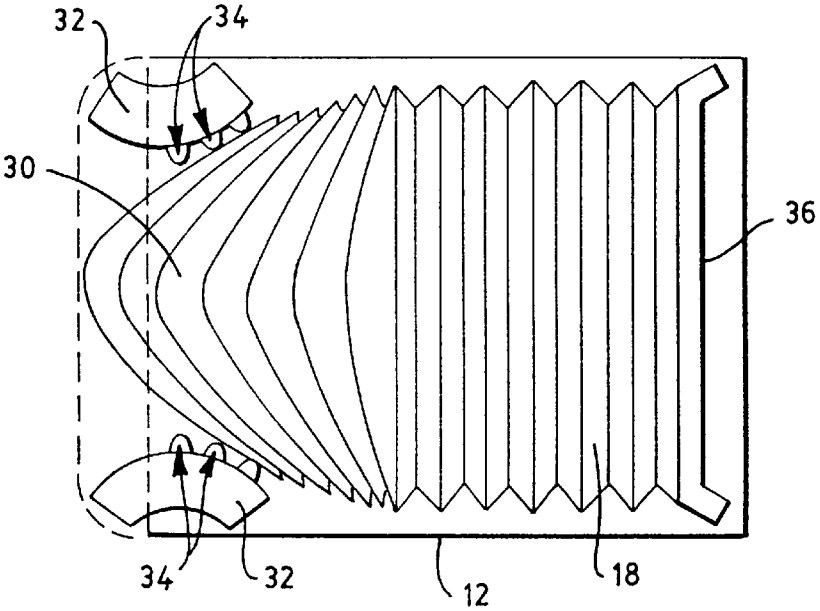
FIG. 3 is an illustration of a detail of an exemplary folded web product dispensing system.

Referring now to FIG. 3, the stacking means 16 are composed of a staging area 30 proximate the dispensing throat 24 for spacing and slowing napkins as they approach the dispensing throat. The staging area 30 may be composed of at least two bumpers 32 oriented so as to be parallel to the path of travel of the napkins as they approach the dispensing throat, and a number of ribs 34 defined on the bumpers 32 for temporarily arresting movement of the napkins as they approach the dispensing throat.

The bumpers 32, in combination with a spring loaded plate 36 that pushes against the stack of napkins 18, cause the folded napkins to bow out or buckle into the dispensing throat 24. Such a configuration is believed to aid dispensing of the napkins by causing the napkins to feed into the dispensing throat 24 relatively uniformly and relatively independent of how full the dispenser is during dispensing. The bumpers also center the napkins on the dispensing throat to reduce the likelihood that napkins will drag against an end of the dispensing slot creating friction that may tear a napkin and interrupt dispensing. The bow or buckle in the napkins is thought to enhance the contact/friction between folded sheets (e.g., interfolded or interleaved sheets) of the paper napkin for more reliable dispensing.

Figure 4:
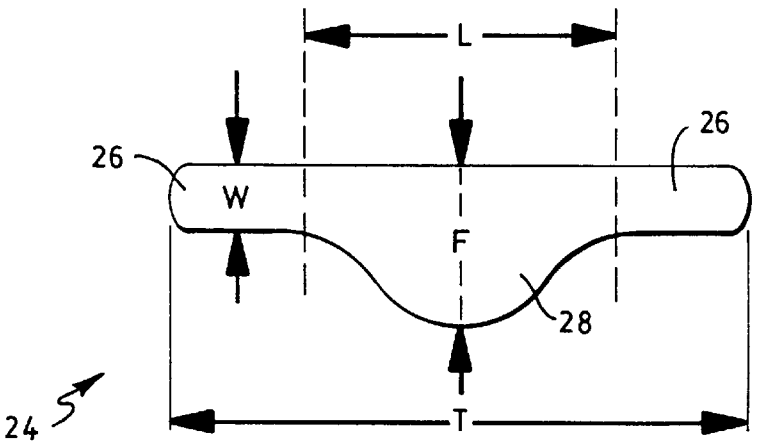
FIG. 4 is an illustration of a dispensing throat of an exemplary web product dispensing system.

Referring now to FIG. 4, there is shown a detail of the dispensing throat 24 which reveals a configuration to prevent large clumps of paper napkins from being pulled out of the dispenser at one time. Specifically, the dispensing throat 24 has a slot portion 26 that has a length sufficient to permit a paper napkin to be pulled through by a user, but a relatively narrow width that will prevent more than a few paper napkins from being pulled through the throat at one time. The dispensing throat 24 includes a finger access portion 28 to help a user grip and pull a paper napkin through the dispensing slot 26 despite the relatively narrow width of the slot.

The slot portion 26 of the dispensing throat 24 may have a point of minimum width "W" that is less than about 1.0 inch. For example, the slot portion "W" of the dispensing throat may have a point of minimum width that is less than about 0.75 inches. As another example, the slot portion "W" of the dispensing throat may have a point of minimum width that is less than about 0.5 inches.

The finger access portion 28 of the dispensing throat may have a point of maximum width "F" that is greater than about 0.75 inches. For example, the finger access portion of the dispensing throat may have a point of maximum width "F" that is greater than about 1 inch.

Desirably, the finger access portion 28 of the dispensing throat 24 is at the center of the dispensing throat and may have a length "L" (i.e., a length along the dispensing throat) of about 1 inch or more. For example, the finger access portion of the dispensing throat may have a length "L" from about 1 inch to about 3 inches or more. Typically, the finger access portion of the dispensing throat may have a length "L" that is about one-half the total length "T" of the dispensing throat. Of coarse, it is contemplated that the finger access portion of the dispensing throat may have a length "L" that is about one-quarter to about three-quarter the total length "T" of the dispensing throat.

Figure 5:
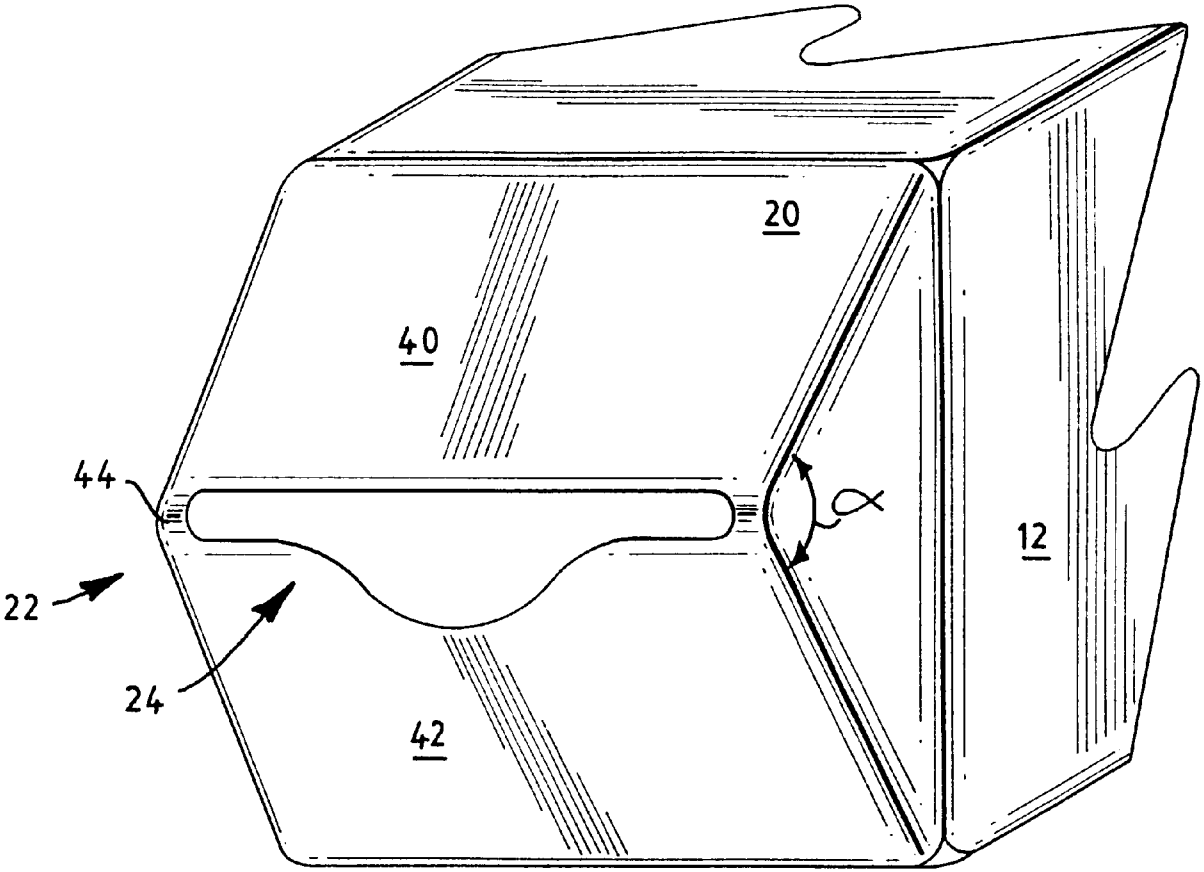
FIG. 5 is a perspective view illustration of a dispensing face from an exemplary folded web product dispensing system.

Referring now to FIG. 5, it can be seen that the central portion 22 of the dispensing face 20 projects out from the outer housing 12 of the dispenser. In an embodiment of the invention, the central portion 22 of the dispensing face 20 projects out in the form of a first surface 40 and a second surface 42 joined at an obtuse angle $\alpha$ (i.e., greater than 90 and less than 180 degrees). The dispensing throat 24 should be located at about the intersection 44 of the first and second surfaces 40, 42 where there is a crease or break in the plane of the dispensing face 20. Such configuration is thought to provide better access to the paper napkins through the relatively narrow dispensing slot 26. It is contemplates that other configurations of the dispensing face which provide a suitable crease or break in the plane of the dispensing face at the dispensing throat may be used.

Generally speaking, the angle α may range from about 175 degrees to about 160 degrees to provide a crease or break in the plane of the dispensing face 20. For example, the angle α may range from about 173 degrees to about 162 degrees. As another example, the angle α may range from about 170 degrees to about 165 degrees.

During normal operation, a consumer will grasp the folded paper napkin by grabbing the portion or tail of the folded napkin protruding/extending through the dispensing slot. As the folded napkin is dispensed, another portion of the succeeding napkin is withdrawn to provide the next outwardly extending protruding portion/tail of the napkin. If the consumer encounters a new stack of folded napkins in which the tail does not protrude through the dispensing slot 26 or if the previous dispensing failed to properly draw a new tail through the slot, the user will grasp the exposed portion of the paper napkin and pinch the body of the napkin by placing one or more fingers in the finger access portion 28 of the dispensing throat 24. If the user pulls too aggressively, such as in an attempt to pull a large clump of paper napkins out of the dispenser, the attempt will be thwarted because a large clump of napkins will not fit through the dispensing slot 26. Accordingly, wasteful dispensing of the paper napkins is reduced.

Figure 6A:
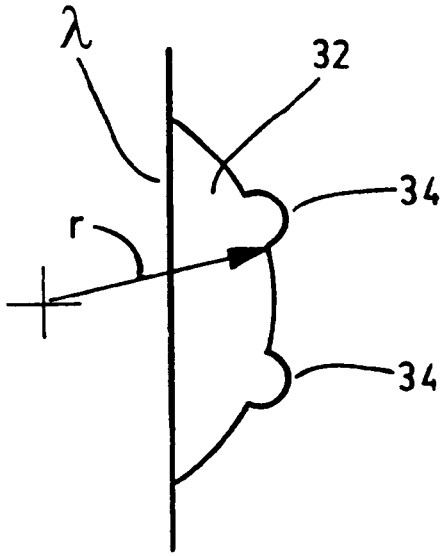
FIG. 6A is an illustration of an exemplary curved bumper.
Figure 6B:
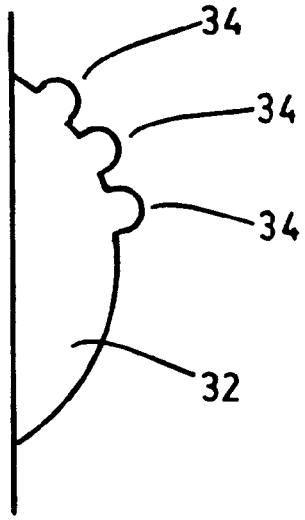
FIG. 6B is an illustration of an exemplary curved bumper.

FIGS. 6A and 6B show exemplary profiles of the curved bumpers 32. As shown, the exterior curve of the bumper is defined by a radius r of from about 1 to about 2 inches. For example, the exterior curve may be defined by a radius r of from about 1.125 to about 1.750 inch. The bumper may have a chordal length λ of from about 1.5 to about 2.0 inch. For example, the bumper may have a chordal length λ of from about 1.625 to about 1.875 inch. It is contemplated that other bumper shapes and radii of curvature may be used. Multiple ribs 34 are shown on the curved bumpers 32. These ribs each may have a radius of from about 0.1 to about 0.5 inch. For example, each rib may have a radius of from about 0.125 to about 0.250. Various combinations of rib radii may be used. For example, smaller ribs may be used in combination with larger ribs. The ribs 34 may be placed evenly on the curved bumper 32 as shown in FIG. 6A. Alternatively and/or additionally, the ribs 34 may be concentrated on a portion of the curved bumper 32 as shown in FIG. 6B.

According to the invention, the dispensing system is designed to work with a stack of individual folded webs as well as conventional overfolded webs or interfolded webs.

The individual folded webs may composed of: (a) a first, central panel; (b) a second panel, unitary with said first panel and folded over a first side of said first panel; (c) a third panel, unitary with the first panel, and folded over a second side of the first panel; (d) a fourth panel, unitary with the second panel, and folded so as to be positioned between the first and second panels; and (e) a fifth panel, unitary with the third panel, and folded so as to be positioned between the first and third panels, such that a portion of the third panel and fifth panel overlap a portion of the second panel and fourth panel generating an area of non-uniform thickness across the length of the web.

Figure 7:
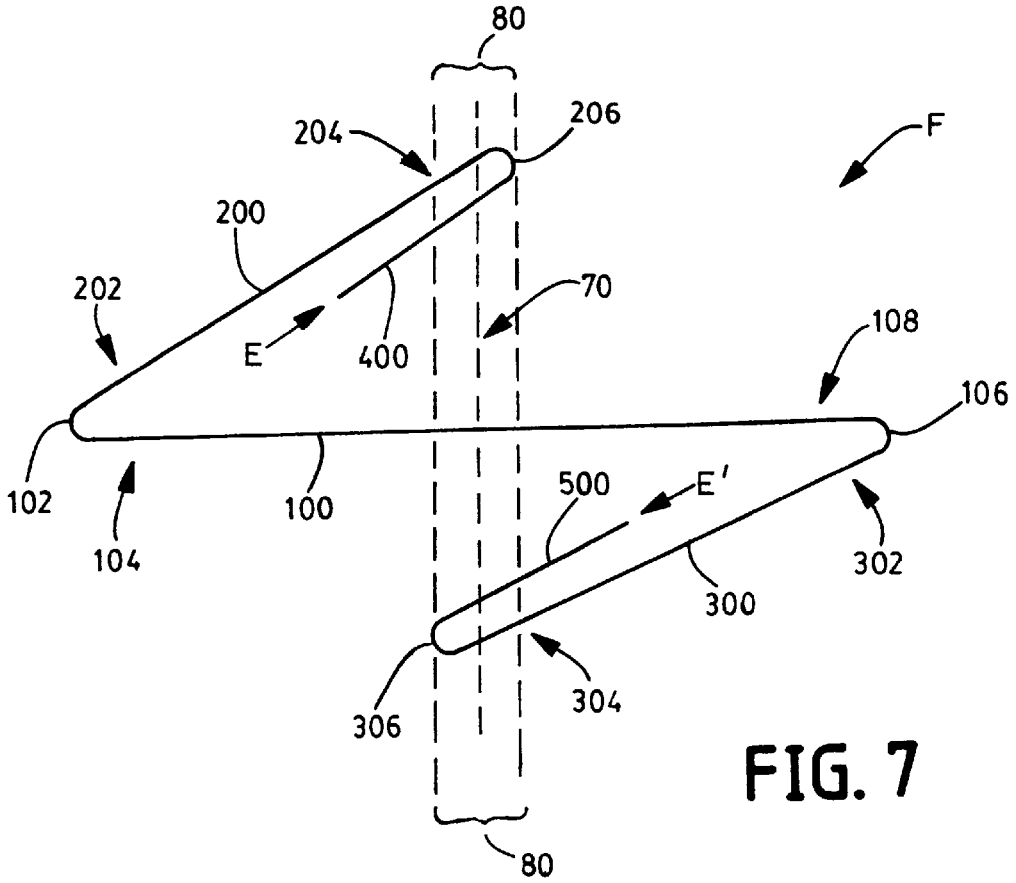
FIG. 7 is an illustration of a cross section of an exemplary individual folded web.
Figure 8:
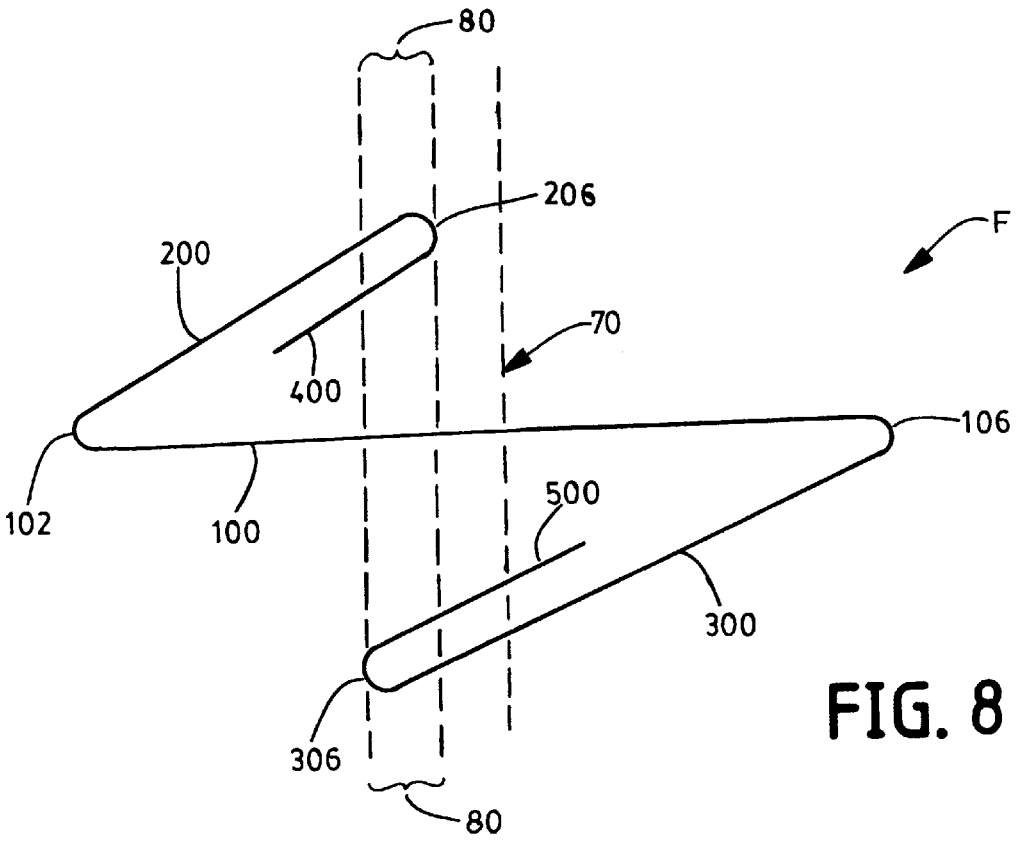
FIG. 8 is an illustration of a cross section of an exemplary individual folded web.
Figure 9:
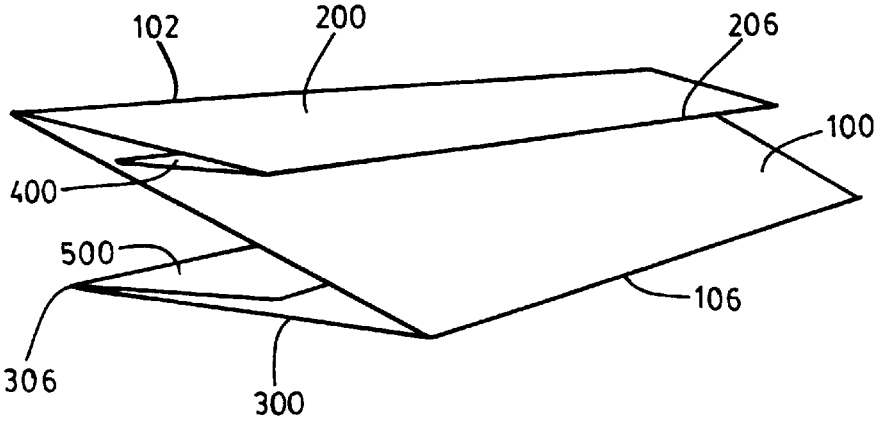
FIG. 9 is a perspective view of an exemplary individual folded web depicted in FIG. 8.

More particularly and with reference to FIG. 7, the folded web "F" includes a first, central panel 100 that has a first fold line 102 at a first end 104 and a second fold line 106 at a second end 108 that is opposite from the first end 104. The folded web "F", further includes a second panel 200 having a first end 202 that is joined with the first panel 100 at the first fold line 102 and a second end 204 having a third fold line 206 defined thereat. A third panel 300 having a first end 302 that is joined with the first panel 100 at the second fold line 106 further includes a second end 304 having a fourth fold line 306 defined thereat. The folded web "F" also includes a fourth panel 400 that is joined to the second panel 200 at the third fold line 206. The fourth panel 400 is folded with respect to the second panel 200 at the third fold line 206 so that fourth panel 400 is positioned substantially between the first panel 100 and the second panel 200. Similarly, the folded web "F" includes a fifth panel 500 that is joined to the third panel 300 at the fourth fold line 306. The fifth panel 500 is folded with respect to the third panel 300 at the fourth fold line 306 so that the fifth panel 500 will be positioned substantially between the third panel 300 and the first panel 100 when folded as shown in FIGS. 7, 8 and 9.

A first edge "E" of the folded web "F" is defined on an end of the fourth panel 400 that is opposite from the third fold line 206. Similarly, the folded web "F" includes a second edge "E'" that is on the fifth panel 500 and is positioned opposite from the fourth fold line 306. Since the fourth and fifth panels 400, 500 are folded so as to be between the second and third panels 200, 300, respectively, and the first panel 100, the first and second edges E, E' will not be readily visible to an observer.

An important feature of the present invention is that the combined width of the second and third panels 200, 300 are greater than the width of the first panel 100, which will insure that the web product "F" has a zone or region of non-uniform thickness extending across the length of the folded web product in a central region when the product is folded flat.

The width of the first panel 100 is defined as being the distance from the first fold line 102 to the second fold line 106. The width of the second panel 200 is defined as being the distance from the first fold line 102 to the third fold line 206, and the width of third panel 300 is defined as being the distance from the second fold line 106 to the fourth fold line 306.

Figure 10:
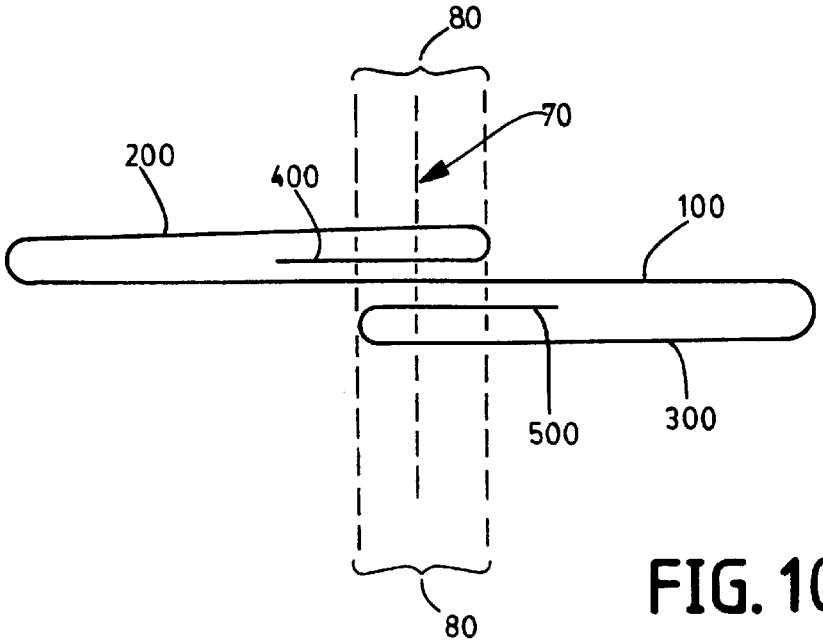
FIG. 10 is an illustration of a cross section of an exemplary individual folded web.

A mid-point 70 of the distance on first panel 100 between first fold line 102 and second fold line 106 is indicated in FIGS. 7 and 10. In the embodiment of FIGS. 7, 9 and 10, the second panel 200 and the third panel 300 have the same width which, in combination, is greater than the width of the first panel 100. This causes the third fold line 206 to be positioned on an opposite side of the mid-point 70 from first fold line 102 and the fourth fold line 306 to be positioned on the opposite side of the mid-point 70 from the second fold line 206. Such a configuration causes a portion of the second panel 200 and fourth panel 400 to overlap a portion of the third panel 300 and fifth panel 500 generating a zone or region 80 of non-uniform thickness across the length of the folded web "F". As can be seen in FIGS. 7 and 10, the zone or region 80 of non-uniform thickness is centered on the mid-point 70.

In the embodiment of FIG. 8, the second panel 200 has a width that is less than the width of the third panel 300. Importantly, the combined width of the second panel 200 and the third panel 300 is greater than the width of the first panel 100 so a portion of the second panel 200 and fourth panel 400 to overlap a portion of the third panel 300 and fifth panel 500 generating a zone or region 80 of non-uniform thickness across the length of the folded web "F". The lack of symmetry between the second panel 200 and the third panel 300 shifts the zone or region 80 of non-uniform thickness away from the mid-point 70. Such a configuration is desirable for dispensers having an offset opening.

According to an embodiment of the invention, the width of the fourth panel 400 may be less than one-half the width of the second panel 200. Alternatively and/or additionally, the width of the fifth panel 500 may be less than one-half the width of the third panel 300. Such a configuration enhances the difference in thickness (i.e., the non-uniform thickness) of the folded web product by concentrating the overlaying of the panels in the central region of the folded web product. For example, in the center of the folded web product, portions of the second panel 200, the fourth panel 400, the first panel 100, the fifth panel 500 and the third panel 300 will be stacked on over each other to provide a thickness equivalent to five (5) sheets of material. When the width of the fourth panel 400 is less than the second panel 200 (e.g., the fourth less than ½ the width of the second panel) and when the width of the fifth panel 500 is less than the third panel 300 (e.g., the fifth panel less than ½ the width of the third panel), the non-central regions or outer regions of the folded sheet product have a thickness equivalent to only two (2) sheets of material. Thus, the outer regions of the folded sheet product have a thickness that is less than one-half (i.e., ⅖) the thickness of the central region.

Figure 11:
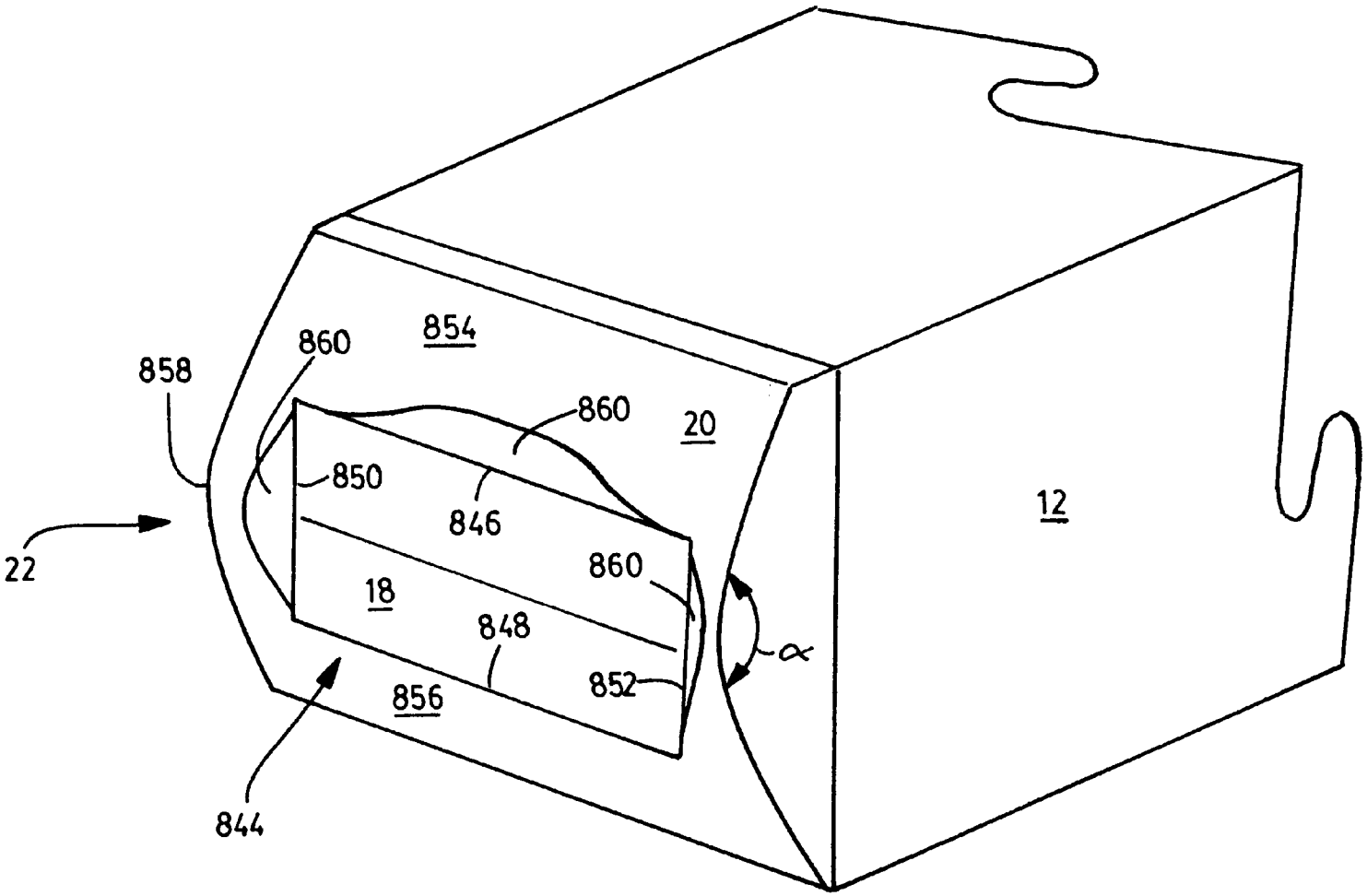
FIG. 11 is an illustration of a detail of a dispensing face from an exemplary folded web product dispensing system.

Referring now to FIG. 11, when such individual folded webs are used, the dispensing face 20 of the dispenser may be configured to have a central portion 22 projecting out from the outer housing 12 and a dispensing throat 844 located in the central portion 22. The dispensing throat 844 may be defined by the edges of the dispensing face and should have a width that is slightly less than the width of the individual folded web (e.g., paper napkin) that is to be dispensed. The dispensing throat 844 has a top edge 846, a bottom edge 848, a first side edge 850 and a second side edge 852.

It can be seen in FIG. 11 that the central portion 22 of the dispensing face 20 projects out from the outer housing 12 of the dispenser. The central portion 22 of the dispensing face 20 projects out in the form of a first surface 854 and a second surface 856 joined at an obtuse angle $\alpha$ (i.e., greater than 90 and less than 180 degrees). The dispensing throat 844 should be located at about the intersection 858 of the first and second surfaces 854, 856 where there is a crease or break in the plane of the dispensing face 20. It is contemplated that other configurations of the dispensing face which provide a suitable crease or break in the plane of the dispensing face at the dispensing throat may be used.

Generally speaking, the angle $\alpha$ may range from about 175 degrees to about 160 degrees to provide a crease or break in the plane of the dispensing face. For example, the angle $\alpha$ may range from about 173 degrees to about 162 degrees. As another example, the angle $\alpha$ may range from about 170 degrees to about 165 degrees.

One feature of the present invention is the one or more recessed sections 860 along at least one edge of the dispensing throat which contacts the stack of individual folded webs so that a portion of the stack of individual folded webs projects outward from the dispensing throat. These recessed sections 860 are desirably located along the top edge 846, first side edge 850, and the second side edge 852 of the dispensing throat 844 which contact the stack of individual folded webs and should have dimensions such that a portion of the stack of individual folded webs projects outward from the dispensing throat.

By pressing against the stack of individual folded webs, the recessed portions 860 located at the first side edge 850 and the second side edge 852 also make it more difficult for a consumer to insert one or more fingers into the dispensing throat to grasp a clump of webs. Accordingly, wasteful dispensing of the folded webs is reduced.

EXAMPLE

The force required to dispense conventional individual overfolded paper napkins from a standard horizontal and vertical mount paper napkin dispenser was measured. The force required to dispense individual overfolded paper napkins from a conventional dispenser with a modified dispensing throat and curved bumpers with ribs was measured. In addition, the force required to dispense individual overfolded paper napkins from a conventional dispenser with a modified dispensing throat but lacking the curved bumpers with ribs was measured. The procedure is as follows:

METHOD

Horizontal Test

1) Load a standard K-C #09460 napkin dispenser (horizontal and vertical mount) available from Kimberly-Clark Corporation, Roswell, Ga. with 20 standard overfolded product napkins. Behind the standard napkins, load an additional clip of approximately 200 napkins to fill the dispenser. The spring within the dispenser exerts a force of approximately 1.5 lbs. on the napkins. This force is constant for all the tests.

2) Close the dispenser. Pull out the first 10 napkins in the dispenser and discard them. Generally speaking, the first few napkins loaded tend to dispense erratically, possibly due to crushing.

3) Attach one end of a binder clip to the exposed napkin in the dispenser throat. Attach the other end to a calibrated force gauge. Pull the force gauge away from the napkin, parallel to the horizontal surface the dispenser is resting on, at a constant speed of approximately 0.5 in/sec. Record the peak force required to dispense the napkin.

4) Repeat step 3 until all 10 napkins are dispensed.

5) Replace the standard K-C #09460 napkin dispenser with a modified K-C #09460 napkin dispenser. This dispenser has been modified to have the dispensing throat opening shown in FIG. 4. The width "W" of the slot portion of the dispensing throat opening was about 0.5 inches, the width "F" of the finger access portion of the dispensing throat opening was about 1 inch, the length "L" of the finger access portion was about 1.5 inches and the total length "T" of the dispensing throat opening was about 3 inches. Curved bumpers of hard plastic (having the general configuration depicted in FIG. 6B) were mounted in the dispenser generally as shown in FIG. 3. The exterior curve of the bumper as defined by a radius r was about 1.5 inches. The chordal length $\lambda$ of the bumper was about 1.75 inch. Each rib on the bumper had a radius of 0.2 inch.

6) Remove the curved bumpers from the modified K-C #09460 napkin dispenser and repeat steps 1 through 5.

Vertical Test

1) Remove the spring in all the napkin dispensers. The weight of the napkins (20 test napkins and the clip of 200) is approximately 1.3 lbs. In the vertical position, the weight of the napkins is approximately equivalent to the horizontal spring force.

2) Repeat steps 1 through 6 from the horizontal test with the dispensers now mounted to a vertical surface.

The results of testing are reported in Table 1 and Table 2.

TABLE 1

| | Horizontal (Table Top) Dispensing | | |
|---|---|---|---|
| TRIAL | STANDARD DISPENSER STANDARD PRODUCT (6.6 × 5.0) | MODIFIED DISPENSER* STANDARD PRODUCT (6.6 × 5.0) | MODIFIED DISPENSER** STANDARD PRODUCT (6.6 × 5.0) |
| 1 | 8 | 4 | 20 |
| 2 | 10 | 2 | 14 |
| 3 | 6 | 4 | 16 |
| 4 | 8 | 4 | 14 |
| 5 | 6 | 6 | 18 |
| 6 | 8 | 4 | 20 |
| 7 | 8 | 4 | 20 |
| 8 | 8 | 4 | 22 |
| 9 | 6 | 6 | 24 |
| 10 | 10 | 4 | 22 |
| AVERAGE | 7.8 | 4.2 | 19 |

*W/BUMPERS
**W/OUT BUMPERS

TABLE 2

| | Vertical (Wall Mount) Dispensing | | |
|---|---|---|---|
| TRIAL | STANDARD DISPENSER STANDARD PRODUCT (6.6 × 5.0) | MODIFIED DISPENSER* STANDARD PRODUCT (6.6 × 5.0) | MODIFIED DISPENSER** STANDARD PRODUCT (6.6 × 5.0) |
| 1 | 6 | 4 | 22 |
| 2 | 10 | 4 | 16 |
| 3 | 8 | 4 | 16 |
| 4 | 8 | 6 | 14 |
| 5 | 6 | 4 | 18 |
| 6 | 8 | 6 | 18 |
| 7 | 8 | 4 | 20 |
| 8 | 8 | 4 | 20 |
| 9 | 10 | 6 | 22 |
| 10 | 8 | 4 | 22 |
| AVERAGE | 8.2 | 4.6 | 18.8 |

*W/BUMPERS
**W/OUT BUMPERS

The dispenser having the modified dispensing throat and the curved bumpers was superior in terms of providing reduced dispensing force to the other dispenser designs. Reduction in dispensing forces appeared to be quite good for both horizontal and vertical dispensing.

Generally speaking, the present invention is believed to be particularly desirable for use with horizontally placed folded paper napkin dispensers. The curved bumpers provide desirably reduced dispensing force. The combination of a narrow dispensing throat, projecting dispensing face, stacking means and curved bumpers that bow out the napkins in a staging area provide reliable and less wasteful dispensing of folded paper napkins.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folded web product dispenser comprising:

an outer housing defining an interior space;

a dispensing face defined in the outer housing proximate to an end of a stacking means, the dispensing face having a central portion and a dispensing throat located in the central portion; and stacking means mounted within the outer housing for holding a stack of folded web product within the interior space, the stacking means comprising a staging area proximate the dispensing throat including at least two curved bumpers oriented so as to be parallel to the path of travel of the folded webs as they approach the dispensing throat, and a number of ribs defined on the bumpers for temporarily arresting movement of the folded webs as they approach the dispensing throat, said bumpers disposed within said outer housing so as to contact the leading web of the stack of folded web product to cause an initial bowing of the folded web product towards said dispensing throat.

2. The dispenser according to claim 1, wherein the staging area and bumpers are configured to cause the folded webs to bow out into the dispensing throat.

3. The dispenser of claim 1, wherein the folded web product is in the form of a stack of paper napkins.

4. The dispenser of claim 1, wherein the curved bumpers have an exterior curve defined by a radius of from about 1.125 to about 1.750 inch and a chordal length of from about 1.625 to about 1.875 inch.

5. The dispenser of claim 1, wherein the ribs defined on the curved bumpers each have a radius of from about 0.125 to about 0.250 inch.

6. A folded web product dispensing system comprising:

an outer housing defining an interior space;

a dispensing face defined in the outer housing proximate to an end of a stacking means, the dispensing face having a central portion and a dispensing throat located in the central portion;

a stacking mechanism mounted within the outer housing to hold a stack of folded paper napkins within the interior space, the stacking mechanism comprising a staging area proximate the dispensing throat including at least two curved bumpers oriented so as to be parallel to the path of travel of the folded webs as they approach the dispensing throat, said bumpers disposed within said outer housing so as to contact the leading web of the stack of folded web product to cause an initial bowing of the folded web product towards said dispensing throat; and ribs defined on the curved bumpers and wherein said ribs have a radius of from about 0.125 to about 0.250 inch.

7. The dispensing system according to claim 6, wherein the staging area and bumpers are configured to cause the folded webs to bow out into the dispensing throat.

8. The dispensing system according to claim 6, wherein the curved bumpers have an exterior curve defined by a radius of from about 1.125 to about 1.750 inch and a chordal length of from about 1.625 to about 1.875 inch.

* * * * *